United States Patent [19]

Minami

[11] Patent Number: 4,709,564

[45] Date of Patent: Dec. 1, 1987

[54] DIGITAL LOCK

[75] Inventor: Saburo Minami, Osaka, Japan

[73] Assignee: Osaka Kanagu Co., Ltd., Osaka, Japan

[21] Appl. No.: 798,682

[22] Filed: Nov. 15, 1985

[51] Int. Cl.[4] ..... E05B 37/18

[52] U.S. Cl. ..... 70/25; 70/299; 70/313

[58] Field of Search ..... 70/21–29, 70/313, 315, 319, 214, 220, 321, 322, 294, 297–299

[56] References Cited

U.S. PATENT DOCUMENTS

| | | | |
|---|---|---|---|
| 616,647 | 12/1898 | Woodward | 70/25 |
| 1,123,061 | 12/1914 | Alanchikoff | 70/28 |
| 1,276,633 | 8/1918 | Forbes | 70/313 |
| 1,616,725 | 2/1927 | Weigel | 70/299 |
| 1,773,204 | 8/1930 | Scheibner | 70/26 |
| 2,029,080 | 1/1936 | Mills | 70/313 |
| 2,536,429 | 1/1951 | Dury | 70/313 |
| 2,628,490 | 2/1953 | Klein | 70/313 |
| 2,967,419 | 1/1961 | Katona | 70/313 |
| 3,276,231 | 10/1966 | Sanowskis | 70/313 |
| 3,412,587 | 11/1968 | Sanowskis | 70/313 |
| 4,014,194 | 3/1977 | Hartman | 70/313 |
| 4,476,698 | 10/1984 | Treslo | 70/321 X |

*Primary Examiner*—Lloyd A. Gall

*Attorney, Agent, or Firm*—Wenderoth, Lind & Ponack

[57] ABSTRACT

A digital system lock can be unlocked by only pushing several push-buttons in the specified order. This digital system lock is unlocked by the cooperation of mechanical elements, without utilizing a microcomputer device, and does not require a key. If the push-buttons are pushed in an order which does not correspond to the specific order, mechanical elements also prevent the lock from being opened until a return button is pushed and the push-buttons are pushed in the specified order.

1 Claim, 28 Drawing Figures

DIGITAL LOCK

BACKGROUND OF THE INVENTION

1. Field of the Invention

This invention relates to a digital lock which is constructed so that it can be unlocked by only pushing several push buttons, in each of which a numeral, a letter, a symbol or the like is cut, in a specified order.

2. Description of the Prior Art

A digital lock which can be unlocked by pushing several push buttons in a specified order does not involve the trouble of carrying about a key to it. In this connection, it has been devised to utilize a microcomputer device for such digital lock. However, as the microcomputer device is affected easily by ambient humidity and heat, a digital lock in which a microcomputer device is incorporated is restricted to places where it can be used safely, is difficult to miniaturize as the lock, is higher in cost and requires a battery of comparatively large capacity.

SUMMARY OF THE INVENTION

An object of the present invention is to provide a digital lock which solves the above problems. A digital lock of the present invention has several push buttons, a return button and an opening button, all of which are linked with such parts as pawl pieces, a locking piece, a return link, a lock plate, an engaging plate, an engaging key, etc. and by the combination of these parts the digital lock works only by mechanical means.

According to the present invention, if push buttons are pushed in the specified order and then an opening button is pushed, a locking piece slips out and unlocking is made possible, but if a wrong push button is pushed, an engaging plate is caught by an engaging key, whereby unlocking is prevented. In this case, by raising a return link by pushing the return button the unlocking operation is rendered impossible, unless the locking plate is disengaged from the engaging key. A small-sized, convenient and strong digital lock has been developed from such a composition of mechanical elements.

BRIEF DESCRIPTION OF THE DRAWINGS

The nature and advantage of the present invention will be understood more clearly from the following description made with reference to the accompanying drawings, in which.

DESCRIPTION OF A PREFERRED EMBODIMENT

Figure 1:
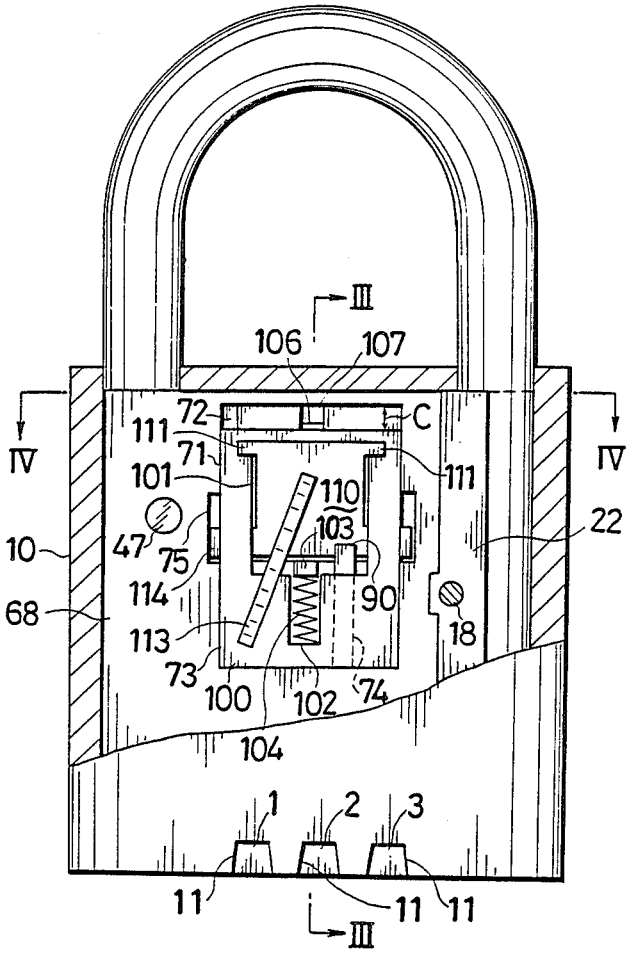
FIG. 1 is a front partial sectional view of an embodiment of the present invention, wherein a front surface of a case is cut away.
Figure 2:
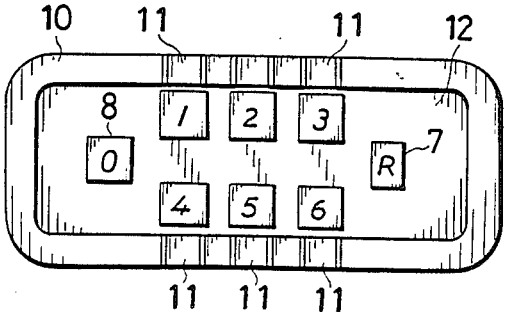
FIG. 2 is a bottom view of FIG. 1.

An embodiment of the present invention is described below with reference to a padlock.

In the embodiment shown in FIG. 1–FIG. 6, numeral 10 denotes a case of a padlock. This case 10 has a flat, square tubular shape, with its upper surface closed. Three sets of recesses 11 are made at opposite lengthwise sides of its bottom margin. Six push buttons 1–6, in each of which a numeral 1–6 is cut respectively, are arranged in two rows between the opposite sets of recesses 11. A return button 7, in which the letter "R" is cut, and an opening button 8, in which the letter "O" is cut, are arranged at the right side and the left side respectively, of the bottom. The push buttons can be ten, in which numerals 0–9 are cut, or more than ten but the more push buttons there are, the more complicated the mechanism of a lock becomes and even the arrangement of six push buttons involves an immense number of numerical combinations. Therefore, it is not necessary to provide many push buttons. Numeral 13 is a locking rod curved in inverted-J shape and its top end having a cut-out 14 is allowed to enter and exit through a hole 15 at the upper surface of the case 10. The locking rod 13 has a flat surface 16 at the inside of its lower base part and an annular groove 17 at the underside of the flat surface. The base part is inserted deeply into the right side part of the case 10 and is locked by a pin 18. However, if the locking rod 13 is drawn out of the case 10 by the length of the flat surface 16, the pin 18 enters the annular groove 17 and thus the locking rod is allowed to revolve.

Figure 4:
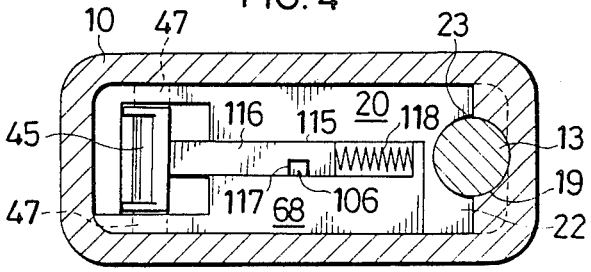
FIG. 4 is a cross section, taken along the line IV—IV in FIG. 1.
Figure 5:
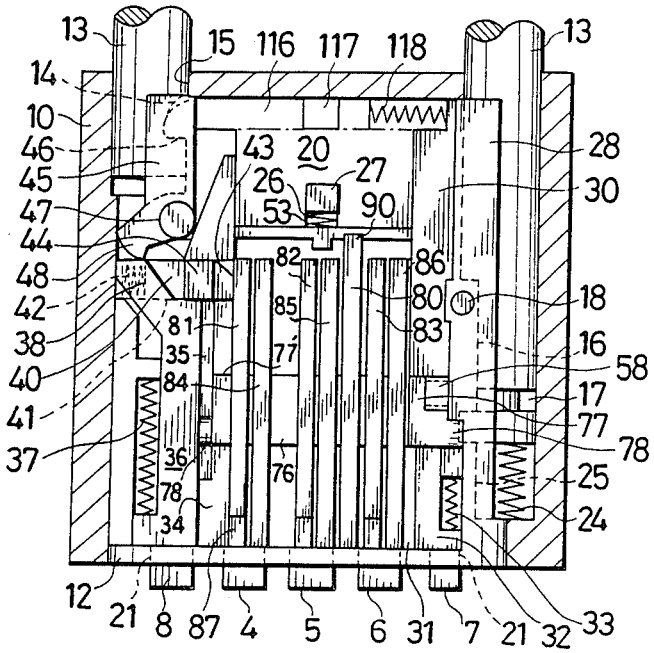
FIG. 5 is a front view of the embodiment from which a front plate is taken away.
Figure 6:
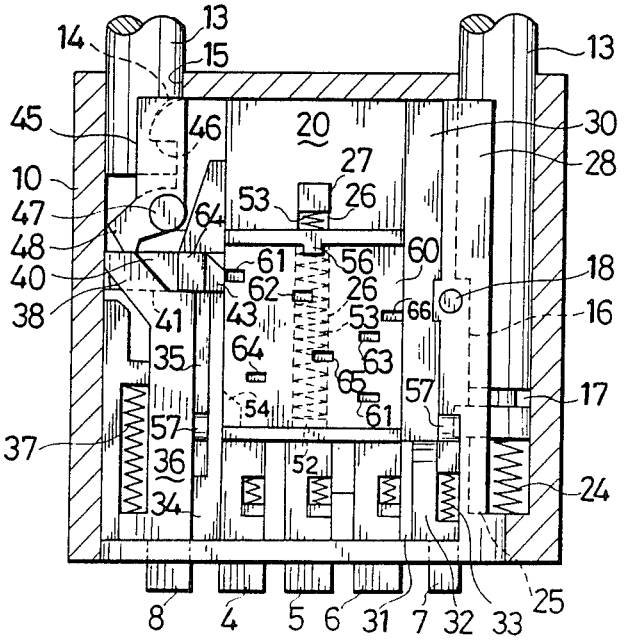
FIG. 6 is a front sectional view of FIG. 1 in which the front plate and pawl pieces are taken away.
Figure 7:
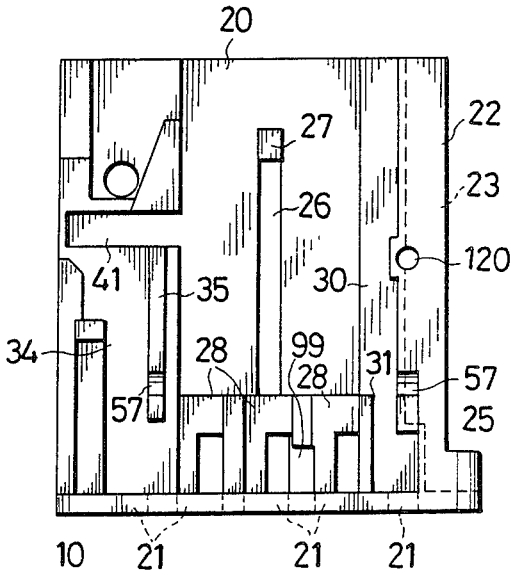
FIG. 7 is a front view of a lock proper.
Figure 10:
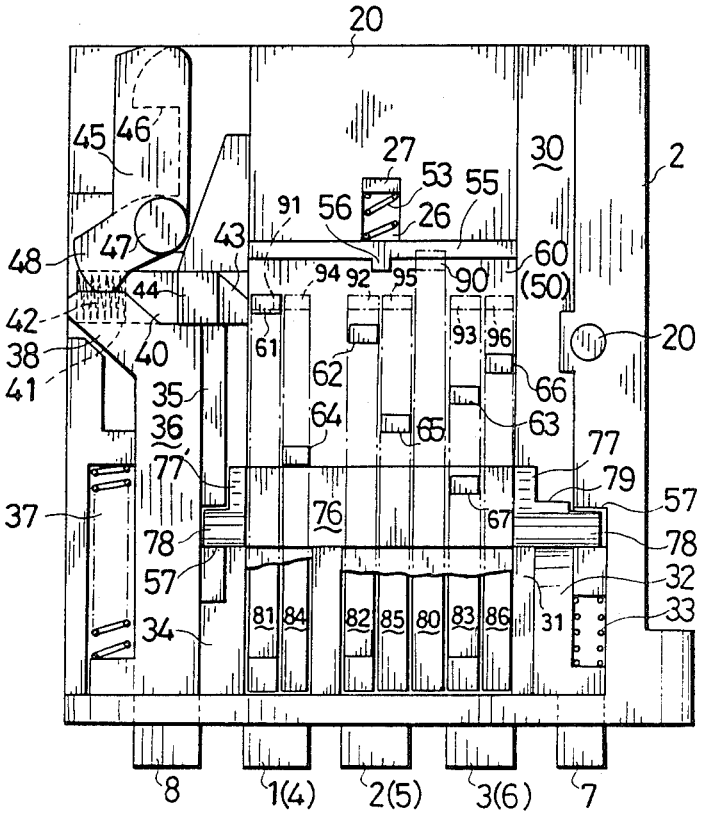
FIG. 10 is a front view, on an enlarged scale, showing the relation between a lock plate and pawl pieces.
Figure 11:
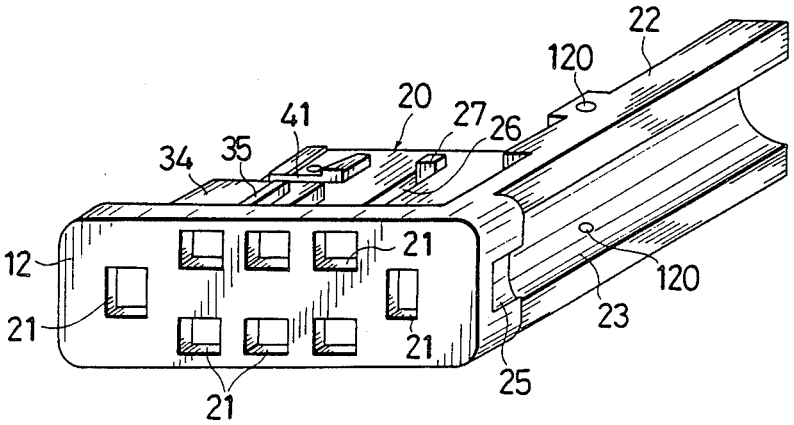
FIG. 11 is a perspective view of the lock proper.

A plate-like lock proper 20 is put in the substantially rear half part of the case 10. As shown in FIGS. 4, 7 and 11, the lock proper 20 is connected at its lower end surface forming a bottom surface 12 of the case 10, with eight button holes 21 made therethrough. A semicircular groove 23 is hollowed out at a side wall 22 of the right side edge of the lock proper, as shown in FIG. 11. This semicircular groove 23, together with another semicircular groove 19 in the right side wall of the case 10, forms a cylindrical hole in which a base part of the locking rod 13 is inserted. A recess 25 in which a push spring 24 for the locking rod is put is made at the innermost part of the semicircular groove 23. A vertical slit 26 in which a spring is put is made at the central part, with a protrusion 27 at its upper end. The lock proper 20 is made thicker at its central lower part, in which three square spaces 28 are made. In these square spaces, push buttons 4, 5, 6 at the rear row and a push spring 29 are put. A shoulder part 30 is made along the whole length of the right side wall and at its lower end portion a short partition wall 31 is provided. Between this partition wall and the right side wall, a short leg piece 32 and a push spring 33 are put in. A lower half part 34 on the right side edge of the lock proper 20 is made thicker and a partition wall 35 is set up. A straight leg piece 36 of the opening button 8 and a push spring 37 are put in between the partition wall 35 and the right side edge. The leg piece 36 is long and a protruding piece 38 is provided at its top end protruding diagally toward the left as seen in FIGS. 5, 6 and 10. Push buttons 1–6, the return button 7 and the opening button 8 are shown in FIGS. 13, 14, 15 and 16.

Figure 17:
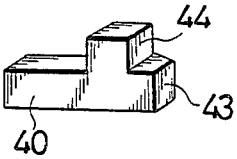
FIG. 17 is a perspective view of a stop piece.
Figure 18:
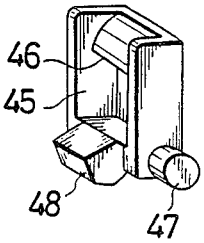
FIG. 18 is a perspective view of a locking piece.

Numeral 40 is a stop piece for the leg piece 36. As shown in FIGS. 5, 6, 10 and 11, the stop piece 40 is put in a horizontal groove 41 made at the intermediate part of the left side of the lock proper 20. A spring 42 is put in a space at the rear part of the groove 41. As shown in FIG. 17, a top end (left end) 43 of the stop piece 40 is made trapezoidal and a protrusion 44 is set up adjacent the top end. This protrusion 44 catches the upper end of the leg piece 36 and stops the entry of the opening button 8. When the stop piece 40 advances rightward and the protrusion 44 comes off the leg piece 36, the opening button 8 can be pushed in. Numeral 45 is a locking piece provided right above the stop piece 40. As shown in FIG. 18, the locking piece 45 is fringed round at the right side of its top end and a shoulder surface 46 to catch in the cut-out 14 of the locking rod. An end axis 47 at the lower end portion is fitted in the lock proper and in a round hole at the upper left corner of a front plate (to be explained later) which covers the lock proper so that the locking piece is made pivotably. Normally, the locking piece 45 takes an upright posture and a protruding piece 48 protrudes diagonally towards the left at its lower end and contacting a protruding piece 38 of the opening button. At this time, the shoulder surface 46 is caught by the cut-out 14 of the locking rod 13 and prevents the locking rod 13 from slipping out.

Figure 19:
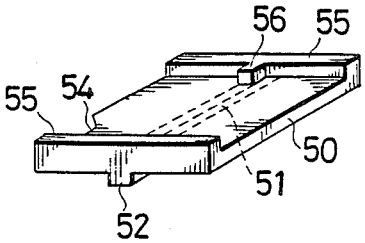
FIG. 19 is a perspective view of a sliding plate.
Figure 20:
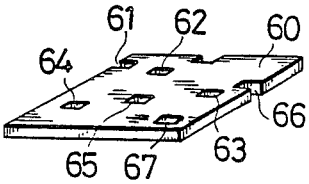
FIG. 20 is a perspective view of a lock plate.

Numeral 50 is a slidable plate which is provided along the central part of the lock proper 20. As shown in FIG. 19, a vertical groove 51 is made at the center of its back surface and a protrusion 52 is made at its lower end. This protrusion 52 is fitted in the slit 26 made at the center of the lock proper 20 so that it guides the vertical motion of the slidable plate 50. At this time, a top end 43 of the stop piece 40 rubs the left side edge of the slidable plate 50, which is kept pushed down by pushing the protrusion 27 and the protrusion 52 by a spring 53 extending over the groove 51 and the slit 26. The slidable plate 50 has a small cut-out 54 of a trapezoidal shape at the lower end portion of its left side edge and when the slidable plate 50 shifts upward by the specified length, the cut-out 54 faces the top end 43 of the stop piece 40. At this time the stop piece 40 advances rightward by being pushed by the spring 42 and causes the top end 43 to enter the small cut-out 54, whereupon the protrusion 44 of the stop piece 40 slides and the stop piece comes off the upper end of the leg piece 36. Numeral 60 is a lock plate which is placed upon the front surface of the slidable plate 50 and between end faces 55, 55 (FIG. 19). In an alternative embodiment the lock plate 60, rather than the slidable plate 50, may be provided with the cut-out 54. The lock plate 60 is prevented from rightward and leftward slipping by means of a projection 56 at the upper end face of the plate 50 and a slot made in the lock plate. As shown in FIG. 20, square perforations 61–66, which receive therein a tip of a pawl piece (to be explained later) which engages with each of the push-buttons 1–6, and one stop hole 67 are made in the lock plate. By changing this lock plate 60, a variation of the key to unlocking can be obtained.

Figure 8:
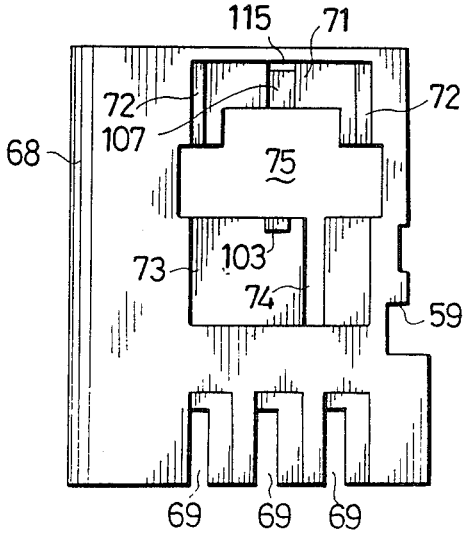
FIG. 8 is a front view of the front plate.
Figure 9:
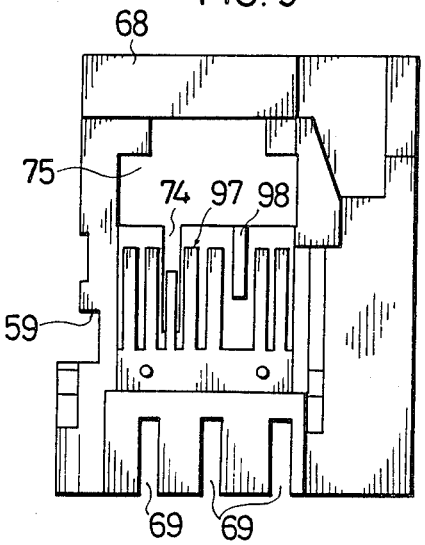
FIG. 9 is a back view of the front plate.

A front plate 68 covers the front surface of the lock proper 20 and by fitting together a concave surface and a convex surface at both side edges the front plate and the lock proper 20 are prevented from "play". As shown in FIGS. 4, 8, 9 and 12, the front plate 68 has at its central lower part three square spaces 69, in which the three front row push-buttons 1 ∝ 3 and push springs 70 are received. The upper part of the rear surface of the front plate is made thicker and a side wall is made at the upper half on the right side. As shown in FIG. 8, a slightly deep, square recess 71 is hollowed out at the upper part of the right side of the front surface, with a shoulder surface 72 having a small width left on both sides. A shallow, square recess 73 is hollowed out at the intermediate part on the rightward front surface and a slit 74 is made at its rightward side. A hole 75 of convex shape is scooped out at the part where two recesses 71, 73 are connected together so that the front surface and the rear surface communicate with each other.

Figure 3:
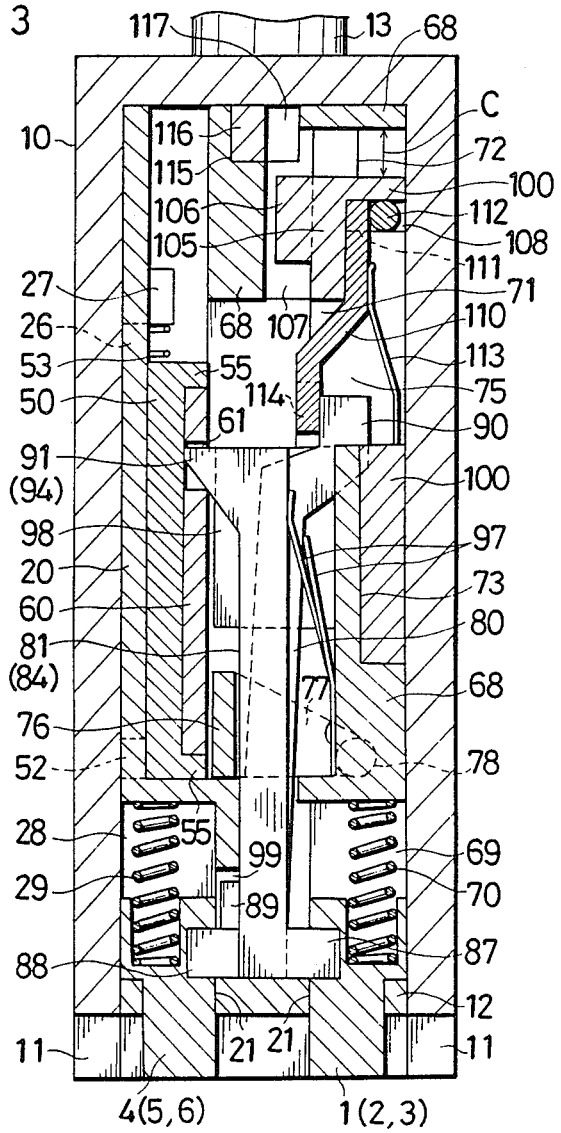
FIG. 3 is a cross sectional view, taken along the line III—III in FIG. 1, on an enlarged scale.
Figure 21:
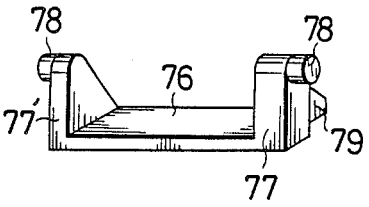
FIG. 21 is a perspective view of a return link.
Figure 22:
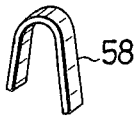
FIG. 22 is a perspective view of a U-shape spring piece.

A return link 76 which is a thin sheet piece is provided along the lower edge portion of the lock plate 60 (FIG. 3). As shown in FIG. 21, the return link 76 comprises square sling pieces 77, 77', with support axes 78, 78 at the top end thereof. The sling piece 77 on the right side is made thicker and is cut off at 79. Support axes 78, 78 are fitted in the recesses 57, 57 at the right side wall 22 and the partition wall 35 on the left side of the lock proper 20 so that the return link is pivotably mounted. Numeral 58 is a spring piece to the return link 76. As shown in FIG. 22, the spring 58 is curved in inverted U-shape and is inserted between the cut off surface 79 of the sling piece 77 and a cut surface 59 of the front plate 68 so that the under surface of the sling piece 77 of the return link 76 may contact the upper end of the leg piece 32. Normally, the return link 76 is along the lower edge part of the lock plate 60, but if the return button 7 is pushed in, its leg piece 32 pushes up the sling piece 77 against the force of the spring piece 58 (FIG. 5) and thus the return link 76 rises up, with the support axes 78, 78 acting as fulcrums and separates slightly from the lock plate 60.

Figure 23:
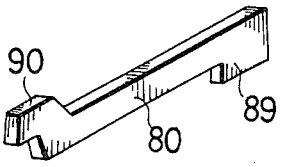
FIG. 23 is a perspective view of a lock pawl.
Figure 24:
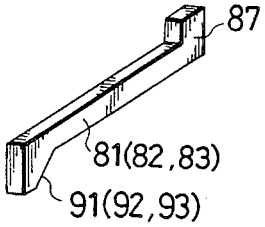
FIG. 24 and FIG. 25 are perspective views of the pawl piece.
Figure 25:
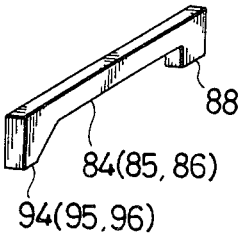

As shown in FIG. 5 and FIG. 10, one long lock pawl 80 and six short pawl pieces 81–86 are provided along the front surface of the lock plate 60. The return link 76 is interposed between these lock pawl/pawl pieces and the lock plate 60. The lock pawl 80, as shown in FIG. 23, carries at its base (lower) end a protruding piece 89 and at its forward end (upper end) a hook-shape piece 90. The protruding piece 89 at the base end is fitted loosely in a recess 99 at the rightward side of the central lower part of the lock proper 20, with the hook-shape piece 90 extending slightly from the lock plate 60. As shown in FIG. 24, the pawl piece 81 (82, 83) carries at the base end thereof a protruding piece 87 and at the forward end thereof a pawl tip 91 (92, 93). The protruding piece 87 at the base end is fitted loosely in a recess whose breadth is one half of that of each of the push-buttons 1–3 so as to communicate with the respective push-button. The pawl piece 91 (92, 93) at the forward end makes contact with the front surface of the lock plate 60. As shown in FIG. 25, the pawl piece 84 (85,

86) carries at the base end thereof a protruding piece 88 and a pawl tip 94 (95, 96) at the front end thereof. The protruding piece 88 at the base end is fitted loosely in a recess whose breadth is one half of that of each push-button 4–6 so as to communicate with the respective push-button. Pawls 94–96 at the front end make contact with the front surface of the lock plate 60. As shown in FIG. 3, numeral 97 is a comb-teeth like spring piece fitted to the rear surface of the front plate 68. This spring piece prevents the lock pawl 80 and pawl pieces 81–86 from raising up. Numeral 98 is a short protrusion provided at the rear surface of the front plate 68. This protrusion makes slight contact with the lock plate 60 at the part where there is no pawl piece to prevent the lock plate from rising up.

The positions of receiving holes 61–66 of the lock plate 60 relate to the order of pushing the push-buttons 1–6. In the embodiment, as shown in FIG. 10 the pawl tip 91 of the push-button 1 which is pushed firstly is in the receiving hole 61 and if the push-button 1 is pushed, the lock plate 60 moves by one pitch (the pushed-in amount of the push-button), together with the slidable plate 50. At this time, the pawl tip 92 falls in the receiving hole 62 and if the push-button 2 is pushed secondly, the lock plate 60 moves further by one pitch. At this time, the pawl tip 96 falls in the receiving hole 66 and if the push-button 6 is pushed thirdly, the lock plate 60 moves by one pitch. At this time, the pawl tip 93 falls in the receiving hole 63 and if the push-button 3 is pushed fourthly, the lock plate 60 moves by one pitch. At this time, the pawl tip 95 falls in the receiving hole 65 and if the push-button 5 is pushed fifthly, the lock plate 60 moves by one pitch. At this time, the pawl tip 94 falls in the receiving hole 64 and if the push-button 4 is pushed sixthly, the lock plate 60 moves by one pitch. In this way, if the push-buttons 1, 2, 6, 3, 5, 4 are pushed in this order, the lock plate 60 moves by six pitches in all, together with the slidable plate 50 and as a result, the cut 54 of the slidable plate 50 moves to the top end 43 of the stop piece 40, whereupon the stop piece 40 moves rightward and allows the movement of the leg piece 36 of the opening button 8, namely, unlocking is made possible. The stop hole 67 made in the lock plate 60 receives the pawl tip 93 when the lock plate 60 moved by six pitches and keeps the lock plate 60 and the slidable plate 50 in their respective moved position.

Figure 12:
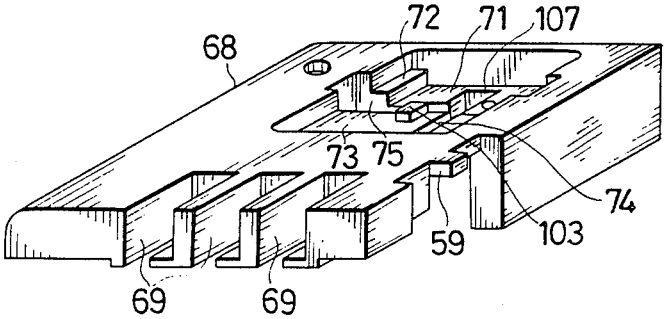
FIG. 12 is a perspective view of the front plate.
Figure 13:
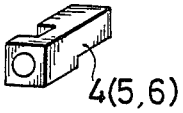
FIG. 13 and FIG. 14 are perspective views of a push button.
Figure 14:
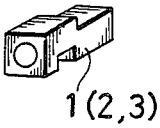
Figure 15:
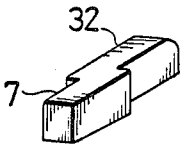
FIG. 15 is a perspective view of a return button.
Figure 16:
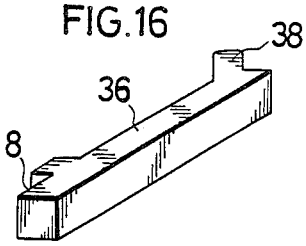
FIG. 16 is a perspective view of an opening button.
Figure 26:
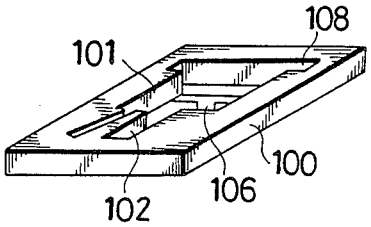
FIG. 26 is a perspective view of an engaging plate.

As shown in FIG. 1 and FIG. 12, an engaging plate 100 is fitted in the recesses 71, 73 and the hole 75, leaving at its upper edge a gap C corresponding to one pitch of the pushed-in amount of the push-button 1–6 so as to allow the upward movement of the engaging plate. As shown in FIG. 26, the engaging plate 100 has a square hole 101 hollowed out at its upper half part and a slit 102 cut out at its lower half part, in which a protrusion 103 (FIG. 8) from the shallow recess 73 and a spring 104 (FIG. 1) are fitted respectively. The spring 104 forces the engaging plate 100 to be pushed down so as to maintain the gap C at its upper edge. The engaging plate 100 is made thicker at an upper edge 108 of its rear surface to correspond to the deep recess 71 of the front plate 68 and both ends of the thicker part are cut off to correspond to the shoulder surfaces 72, 72 of the front plate 68. A protrusion 106 is made at the center of the rear surface of the thicker part and is fitted in a groove 107 made at the center of the concave 71 of the front plate 68.

Figure 27:
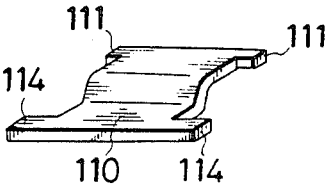
FIG. 27 is a perspective view of a mediating piece.

Numeral 110 is a mediating piece which is fitted loosely in the square hole 101 of the engaging plate 100. As shown in FIG. 27, the mediating piece is slightly curved at its intermediate part and small protrusions 111 at both of its upper ends are fitted in the recess 108 of the square hole 101 (FIG. 26) along with a push-pin 112. Thus, the mediating piece 110 is supported swingably with the protrusions 111, 111 acting as fulcrums but is pressed at its front surface by a spring piece 113 fitted to the engaging plate 100. Both ends 114, 114 at the lower edge of the mediating piece 110 protrude sidewise and owing to the curvature at the intermediate part, the lower edge is received in the hole 75. Since the front surface of the mediating piece 110 is pressed by the spring piece 113, the lower edge of the mediating piece 110 is forced out to the rear side to the front plate 68 and therefore protrusions 114, 114 at the lower edge are positioned at the rear surface of the engaging plate 100, with a certain gap therebetween. Pawl pieces 81–86 face, at their upper ends, the lower edge of the mediating piece 110 and the upper end 90 of the lock pawl 80 extends through the slit 74 and is placed on one portion of the lower edge 114 of the mediating piece.

Figure 28:
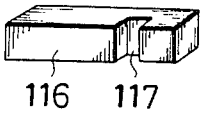
FIG. 28 is a perspective view of an engaging key.

Numeral 115 is a groove made in the upper surface of the front plate 68 and communicates with the groove 107 made at the center of the recess 71. When the engaging plate 100 moves upward and the space C is narrowed, the protrusion 106 enters in the groove 115. Numeral 116 is an engaging key. As shown in FIG. 28, the engaging key 116 has at its rear portion a notch 117 and is put in the groove 115 of the front plate 68, together with the push spring 118, and its top end (left edge) is made to contact the rear surface of the locking piece 45. Normally, the notch 117 faces the groove 107 of the front plate 68 and can retreat inside the groove 115 against the force of the spring 118. In this state, the locking piece 45 is rotatable rightward and if the protrusion 106 of the engaging plate 100 thrusts into the groove 115, it is caught by the notch 117, whereby the retreatment of the engaging key 116 is prevented and the lock plate 45 is made unrotatable.

If a wrong push-button was pushed, an upper end of its pawl piece pushes the lower end of the mediating piece 110, which moves upward together with the engaging plate 100 against the force of the spring 104, whereupon the lock pawl 80 being pressed by the spring piece 97 moves rearward and its key-shape piece 90 receives the lower end of the mediating piece 110 and maintains the engaging plate 100 in its position with the space C narrowed. At this time, the protrusion 106 of the engaging plate 100 is caught by the notch 117 of the engaging key and the engaging plate is prevented from retreating, whereby the lock piece 45 is prevented from rotation and unlocking is made impossible. Then, if the return button 7 is pushed to raise the return link 76, the lock pawl 80 moves forward, puts the key-shape piece 90 into the slit 74 of the front plate 68 and separates it from the lower end of the mediating piece 110. Accordingly, the engaging plate 100 moves downward together with the mediating piece 110 due to the elasticity of the spring 104 and returns to its normal state, with the key-shape piece 90 of the lock pawl on its lower edge, whereupon the protrusion 106 of the engaging plate disengages from the engaging key 116 and unlocking operation is rendered possible. At this time, all pawl pieces 81–86 move apart from the lock plate 60 and cut the connection between receiving holes 61–66 and pawl tips 91–96.

An example of a padlock with a digital lock system according to the present invention is comprised as above. In setting it up, first of all push-buttons 4–6 at the rear row, the return button 7, the opening button 8, the stop piece 40, the locking piece 45 and push springs 29, 33, 37, 42 are incorporated in the lock proper 20, the slidable plate 50 on which the lock plate 60 is laid is placed at the central part of the lock proper, the spring 53 is put in the groove 51 and the slit 26, the return link 76 is placed along the lower edge portion of the lock plate 60, with its support axes 78, 78 fitted in the recesses 57, 57 of the lock proper, and is pivotably mounted at the front surface of the lock plate 60. Then, the lock pawl 80 and pawl pieces 81–86 are arranged at the front surface of the lock plate 60. The protruding pawl 89 of the lock pawl 80 is fitted in the recess 99 at the right side of the lock proper and the protruding piece 88 of the pawl pieces 84–86 is fitted in the recesses of the push-buttons 4–6, the return link 76 is interposed between the lock plate 60 and the lock pawl 80/pawl pieces 81–86 so as to put the pawl pieces 81–86 in the specified position.

Next, the front plate 68 in which the push-buttons 1–3 at the front row and the push spring 70 are incorporated is laid on the lock proper 20, with recesses and projections of both fitted together, the protruding piece 87 of the pawl pieces 81–83 is fitted in the recesses of the push-buttons 1–3 at the front row, support axes 78, 78 of the return link 76 are pressed by the front plate 68, the lock pawl 80 and pawl pieces 81–86 are pressed by the comb-teeth like spring piece 97 so as to have pawl tips 91–96 contact the lock plate 60, the lock plate 60 is prevented from rising up by the protrusion 98 at the rear surface of the front plate 68, the spring piece 58 of U-shape is inserted in the cut-off surface of the front plate 68 so as to have the sling piece 77 of the return link 76 contact the return button leg 32. Then, the mediating piece 110 is fitted in the square hole 101 of the engaging plate 100, the protrusions 111, 111 at the upper edge of the mediating piece 110 and the push pin 112 are put in the recess so as to support the mediating piece 110, the lower edge of the mediating piece is set in the hole 75 of the front plate 68 and the protrusions 114, 114 at the lower edges face the rear surface of the engaging plate 100 so as to support the mediating piece 110.

The engaging plate 100 which supports the mediating piece 110 is received in recess 71, 73 of the front plate 68. By pressing the mediating piece 110 by the spring 113 fitted to the engaging plate 100, the lower edge of the mediating piece 110 is forced out to the rear side of the front plate 68. The engaging plate 100 is pressed down by inserting the spring 104 in the slit 102 of the engaging plate 100. Tips of the pawl pieces 81–86 contact the lower edge of the mediating piece 110. The key-shape piece 90 at the top end of the lock pawl is inserted in the slit 74 of the front plate 68 and is placed on the front surface of the lower edge of the mediating piece 110. By means of the slit 74, some allowance is given for the front and rear movement of the lock pawl 80.

The push spring 24 of the locking rod 13 is inserted in the recess 25 of the lock proper 20. The engaging key 116 and the push spring 118 are put in the groove 115 at the upper surface of the front plate 68. The front plate 68 and the lock proper 20 are inserted in the case 10. The locking rod 13 is inserted from the upper surface of the case 10 and its base part is pushed fully in the semicircular groove 23 of the lock proper 20. The pin 18 is driven into the pin hole made in the side wall of the case 10 until it is put in the stop hole 120 of the lock proper 20. The lock proper 20 and the front plate 68 are fixed in the case 10 by caulking both ends of the pin.

In this embodiment, normally the engaging plate 100 is pressed down by the spring 104 so as to provide the space C at the upper edge. The engaging key 116 is made retreatable by disengaging the protrusion 106 from the notch 117 of the engaging key 116. In this state, if the top end of the locking rod 13 is pushed in the hole 15 of the case 10, the locking rod 13 penetrates, while inclining the lock piece 45 rightwardly, and when the top end of the locking rod 13 enters fully, the lock piece 45 is returned by the engaging key 117 and is caught by the notch 14, whereby the drawing out of the locking rod 13 is prevented and the locked state is maintained.

When unlocking is desired, push-buttons 1–6 are pushed in the specified order. In the embodiment, as the pawl tip 91 is in the receiving hole 61 of the lock plate, firstly the push-button 1 is pushed. Upon pushing of the push-button 1, the lock plate 60, accompanied by the slidable plate 50 moves by one pitch (the pushed-in quantity of a push-button). At this time, the pawl tip 92 falls in the receiving hole 62 and if the push-button 2 is pushed secondly, the lock plate 60 draws the pawl tip 91 from the receiving hole 61 and moves by one pitch. At this time, the pawl tip 96 falls in the receiving hole 66 and if the push-button 6 is pushed thirdly, the lock plate 60 draws the pawl tip 92 from the receiving hole 62 and moves by one pitch. At this time, the pawl tip 93 falls in the receiving hole 63 and if the push-button 3 is pushed fourthly, the lock plate 60 draws the pawl tip 96 from the receiving hole 66 and moves by one pitch. At this time, the pawl tip 95 falls in the receiving hole 65 and if the push-button 5 is pushed fifthly, the lock plate 60 draws the pawl tip 93 from the receiving hole 63 and moves by one pitch. At this time, the pawl tip 94 falls in the receiving hole 64 and if the push-button 4 is pushed sixthly, the lock plate 60 draws the pawl tip 95 from the receiving hole 65 and moves by one pitch.

By pushing the push-buttons 1, 2, 6, 3, 5, 4 in this order, the lock plate 60, accompanied by the slidable plate 50 moves by six pitches in all and subsequently the notch 54 of the slidable plate 50 moves to the top end 43 of the stop piece 40, whereupon the stop piece 40 advances rightward by the push spring 42 and enters its top end 43 in the notch 54 of the slidable plate 50, opening the projection 44 near the top end and disengaging it from the top end of the opening button leg 36 and thus allowing it to move. When the lock plate is moved by six pitches, the pawl tip 93 falls in the stop hole 67 of the lock plate and maintains the lock plate 60 and the sliding plate 50 in their respective moved position. Then, if the opening button 8 is pushed in, the protruding piece 38 at the top end of its leg piece inclines the lock piece 45 rightward and disengages the locking piece 45 from the notch 14 of the locking rod 13. Therefore, it is possible to draw the locking rod 13 from the case 10 for unlocking. If the locking rod 13 is drawn out fully, the pin 18 enters the annular groove 17 of the base end of the locking rod 13 and therefore the locking rod 13 can be turned. When the lock is returned to the normal state, the return link 76 is raised by pushing the return button 7 after the locking rod 13 has been drawn out, the pawl pieces 81–86 are moved away from the lock plate 60 to disengage the pawl tips 91–96 from the lock plate 60, and the slidable plate 50 and the lock plate 60 are lowered by the spring 53.

In unlocking, if a wrong push-button is pushed, the top end of its pawl piece pushes the lower edge of the mediating piece 110, which moves upward, together with the engaging plate 100, against the force of the spring 104. The lock pawl 80 which is being pressed by the spring piece 97 moves backward and catches the lower edge of the mediating piece 110 by its key-shape piece 90 and maintains the engaging plate 100 in its moved position narrowing space C. At this time, the protrusion 106 of the engaging plate enters the groove 115 and is caught by the notch 117 of the engaging key, whereby the engaging plate is prevented from retreating. Thus, the locking piece 45 is prevented from revolution and unlocking is rendered impossible. In this case, if the return button 7 is pushed and the return link 76 is raised, the lock pawl 80 moves forward and enters the key-shape piece 90 in the slit 74 of the front plate and separates the key-shape piece 90 from the lower edge of the mediating piece 110. Thus, the engaging plate 100 moves downward, together with the mediating piece 110, due to elasticity of the spring 104 and is returned to its normal state, with the key-shape piece 90 of the lock pawl placed on its lowered edge, and its protrusion 106 disengaged from the engaging key 116, with the result that the unlocking operation is rendered possible.

The foregoing is an example of the padlock to which a digital lock according to the present invention has been applied. The present invention is not limited to the above embodiment but is variable in design within the gist of the present invention. For example, it is possible to eliminate a part of the pawl pieces and to leave some of the push buttons unused. Also, the present invention can be applied to locks other than a padlock.

In the present invention, several push buttons, a return button and an opening button are linked with pawl pieces, a locking piece, a return link, a lock plate, an engaging plate, an engaging key, etc. and a digital lock is composed by only mechanical means which is comprised of these parts. According to this digital lock, if the opening button is pushed after the push buttons were pushed in the specified order, the locking piece is disengaged and unlocking is rendered possible and if a wrong push-button is pushed, the engaging plate is caught by the engaging key and unlocking is checked. In this case, by raising the return link by pushing the return button, opening operation is rendered impossible unless the engaging plate is disengaged from the engaging key. Thus, only by mechanical means and action is the unlocking made possible and a digital lock of small size which is easy to use, strong and convenient can be provided.

What is claimed is:

1. A digital lock having a case, a locking rod lockable within said case, a plate-like lock member and a front plate covering said lock member disposed in said case, a plurality of push-buttons, a return button and an opening button, and digital lock means comprising:

a. a stop piece provided adjacent a forward end of a leg piece of said opening button and movable between a first position for preventing movement of said leg piece and a second position for allowing movement of said leg piece;

b. a locking piece for locking and releasing said locking rod within said case having a protruding piece thereof engaged with a top end of said leg piece of said opening button;

c. a slidable plate disposed between said lock member and said front plate and vertically movable and having a lock plate fitted thereto;

d. a notch in said slidable plate for receiving therein a forward end of said stop piece when said slidable plate and said lock plate are moved vertically by a specified length;

e. a return link provided along the lower edge portion of the lock plate and pivotably mounted by sling pieces having support axes at both ends thereof;

f. a spring piece inserted in a cut-out surface of said front plate for pressing one of said sling pieces against a leg piece of said return button;

g. pawl pieces arranged in front of said lock plate opposite said slidable plate, said return link extending between said pawl pieces and said lock plate, and a comb-teeth shaped spring piece mounted at the surface of said front plate facing said lock member for pressing said pawls against said lock plate;

h. a lock pawl having a protruding piece at its base end fitted loosely in the central lower part of said lock member;

i. a protruding piece at the base end of each of said pawl pieces loosely fitted in a recess of said push-buttons and pawl tips on the forward end of each of said pawl pieces pressed against said lock plate;

j. said lock plate having holes for receiving said pawl tips;

k. said lock plate and said slidable plate being movable by a pitch length each time a push-button is pushed and when the push-buttons are pushed in a correct order;

l. said leg piece of said opening button being movable to an open position when said stop piece is moved to said second position and said forward end enters said notch of said slidable plate after said slidable plate is moved vertically by said specified length;

m. said locking piece being disengaged from said locking rod by said top end of said opening button when said opening button is moved to said opening position whereby unlocking is rendered possible;

n. square recesses in the upper part and the intermediate part of the front surface of said front plate facing away from said lock member, a first groove in the upper part of said front plate open to said square recesses;

o. an engaging plate in said recesses of said front plate being pressed downwards by a spring and leaving a gap corresponding to one said pitch length between the upper edge of said engaging plate and an upper edge of said recesses;

p. a protrusion on the upper edge of the rear surface of said engaging plate fitted in a groove in said recesses of said front plate;

q. a square hole in the substantially upper half of said engaging plate having an intermediate piece loosely fitted thereto;

r. the lower edge of said intermediate piece located in said recesses of said front plate;

s. the front surface of the intermediate piece being pressed by a spring piece fitted to the engaging plate for positioning the lower edge of said intermediate piece at the rear side of said front plate;

t. a top edge of each of said pawl pieces positioned adjacent the lower edge of said intermediate piece, said lower edge positioned adjacent a side of a key-shaped piece of a top end of said lock pawl;

u. said front plate having a second groove in its upper surface open to and communicating with said first groove in said recesses of said front plate, an engaging key and a push spring located in said second groove;

v. said engaging key having one end pressed against the rear surface of said locking piece, whereby when a push-button is pushed out of said correct order an upper end of the respective pawl piece moves said engaging plate from a first position to an unlocking prevention position via said intermediate piece, and the key-shape piece of said lock pawl is moved to maintain the engaging plate at said unlocking prevention position, and when said return button is pushed the return link disengages said lock pawl from said intermediate piece and said engaging plate is returned to said first position.

* * * * *